US006856101B1

(12) United States Patent
Hitchcock

(10) Patent No.: US 6,856,101 B1
(45) Date of Patent: Feb. 15, 2005

(54) METHOD AND APPARATUS FOR SWITCHING OF PARALLEL CAPACITORS IN AN HID BI-LEVEL DIMMING SYSTEM USING VOLTAGE SUPPRESSION

(75) Inventor: William Henry Hitchcock, Newark, OH (US)

(73) Assignee: Acuity Brands, Inc., Atlanta, GA (US)

( * ) Notice: Subject to any disclaimer, the term of this patent is extended or adjusted under 35 U.S.C. 154(b) by 0 days.

(21) Appl. No.: 10/202,522

(22) Filed: Jul. 24, 2002

(51) Int. Cl.[7] ..... H05B 37/02; H05B 37/00

(52) U.S. Cl. ..... 315/227 R; 315/240; 315/DIG. 4; 315/237; 315/291; 315/186; 315/209 R; 315/324

(58) Field of Search ..... 315/227 R, DIG. 4, 315/240, 291, 227, 237, DIG. 5, 186, 209 R, 324, 244, 159, 311, 284, 239

(56) References Cited

U.S. PATENT DOCUMENTS 3,890,573 A * 6/1975 Strenglein ..... 455/319
4,924,109 A * 5/1990 Weber ..... 307/126
5,227,762 A * 7/1993 Guidette et al. ..... 340/310.03
5,327,048 A * 7/1994 Troy ..... 315/240
5,451,843 A * 9/1995 Kahn et al. ..... 315/186
5,633,540 A * 5/1997 Moan ..... 307/126
6,031,340 A * 2/2000 Brosius ..... 315/227 R
6,043,636 A * 3/2000 Gaudreau et al. ..... 323/282

* cited by examiner

*Primary Examiner*—Don Wong
*Assistant Examiner*—Chuc Tran
(74) *Attorney, Agent, or Firm*—Kenneth E. Darnell

(57) ABSTRACT

Switching of parallel capacitors in an HID bi-level lighting control system is accomplished through use of transient voltage suppression across an electronic relay for discharge of residual charge from a switched capacitor when combined peak voltage exceeds clamping voltage, thereby allowing maximum switch voltage rating to be lower than is possible through the use of conventional switching methods and circuitry. The invention contemplates method and apparatus permitting capacitive switching at voltage levels higher than are possible in conventional capacitive switching arrangements including capacitive switching arrangements used in lighting control systems.

22 Claims, 3 Drawing Sheets

METHOD AND APPARATUS FOR SWITCHING OF PARALLEL CAPACITORS IN AN HID BI-LEVEL DIMMING SYSTEM USING VOLTAGE SUPPRESSION

BACKGROUND OF THE INVENTION

1. Field of the Invention

The invention relates to HID bi-level lighting control systems and particularly to the switching of parallel capacitors in such systems using voltage suppression.

2. Description of the Prior Art

Bi-level dimming systems using high intensity discharge lamps are commonly available in the art, prior systems typically functioning through switching of parallel capacitors on constant wattage (CWA) ballasts. In prior systems, switching has been preferably accomplished through use of electronic zero-crossing switches. Output devices within such systems have typically been back-to-back SCR devices or TRIAC devices. In such a system, a switch must be able to sustain twice the peak voltage of a powered capacitor due to the fact that the switch opens at zero current, zero current being peak voltage for a capacitor. In the following half cycle, the voltage of the powered capacitor opposes that charge remaining on a switched-out capacitor. Although bleeder resistors can be employed to slowly discharge the switched-out capacitor, an appreciable decrease only occurs after a number of cycles. Typical solid state switches are voltage limited in most applications to 400 watts thereby limiting the use of such switches to situations where the RMS capacitor voltages are below 300 volts and where twice peak voltages can exceed 900 volts. Such considerations require switch output devices capable of withstanding 1000 volt breakover. In applications exceeding 400 watts, capacitor RMS voltages can reach 525 volts. A value of twice maximum peak voltage can be approximately 1500 volts. Such design considerations require expensive custom relays that are configurable only at unacceptable cost levels for bi-level dimming systems such as are commonly available.

The prior art is replete with bi-level dimming systems usable with HID lamping as can be seen from a review of issued United States patents. These issued patents, however, do not provide an inexpensive solution to the switching function referred to herein when lamping of high wattage is employed within a bi-level lighting system. As examples, Troy, in U.S. Pat. No. 5,327,048, discloses a bi-level lighting control system for operation of high intensity discharge lamping wherein current surges across electrical magnetic relays are reduced by means of current surge prevention devices. Troy does not provide a system compatible with solid state zero-crossing relays, that is, electronic relays, operable with parallel capacitors. In U.S. Pat. No. 4,931,701, Carl discloses a bi-level control system employing a switch capacitor, the system including a solid state zero-crossing relay. The zero-crossing relay of Carl is disclosed as providing a switching-in or switching-out of a switch capacitor timed to occur at a zero-crossing point of applied voltage. The switch capacitor is thus applied or removed only when voltage level is not available to cause excessive voltage spikes or surges by the switched capacitor if said capacitor is partly or fully charged when switched, thereby eliminating damage to other circuit components. Brosius, in U.S. Pat. No. 6,031,340, discloses a zero current crossing capacity switching arrangement for controlling the switching of a capacitor into and out of an HID lead ballast circuit at a time when a current through the capacitor is at or near zero, thereby enabling bi-level operation of an HID lamp. In U.S. Pat. No. 5,811,939, Herniak discloses a bi-level control system utilizing a programmable logic controller for controlling switching in a predetermined sequence to allow switching between voltage sources. Kahn et al, in U.S. Pat. No. 5,451,843, discloses circuitry for providing bi-level illumination utilizing a "random crossing" relay. Guidette et al, in U.S. Pat. Nos. 5,227,762 and 5,475,360 describe a lighting system controllable through a power line carrier system. Nuckolls et al, in U.S. Pat. No. 6,114,816, describes a lighting control system for discharge lamping for switching said lamping between dimmed and normal wattage operational modes.

The bi-level lighting control systems of the prior art including such systems as are described in the aforesaid United States patents do not accommodate the use of high wattage lamping in such systems with low voltage rated switching devices. A system permitting the use of high wattage tamping in bi-level HID lighting control systems at cost levels associated with market requirements in the industry therefore provides a substantial advance in the art.

SUMMARY OF THE INVENTION

The invention provides a controlled capacitor discharge circuit employing transient voltage suppression for lowering peak voltage across an electronic switch within an HID bi-level dimming system. The circuitry of the present invention acts to lower peak voltage across the switch by more than 300 volts allowing use of conventional driver and output components in systems utilizing a switch capacitor wherein peak voltage would normally exceed component ratings. The present circuitry preferably utilizes a Transzorb, a trademark of General Semiconductor, Inc., of Melville, N.Y. 11747, to accurately clamp voltage allowing for a controlled clipping time and magnitude per cycle. In this manner, the Transzorb or transient voltage suppressor is prevented from overheating due to excessive energy dissipation while simultaneously maintaining peak voltage within a predetermined limit. Voltage and power levels can thereby be effectively controlled without the need for expensive circuitry components as would be required in a bi-level system employing high wattage lamping.

The circuitry of the invention is compatible with electronic relays conventionally employed in bi-level dimming systems utilizing relatively low wattage high intensity discharge lamping and particularly such systems employing the switching of parallel capacitors on constant wattage ballasts. In the present system, high wattage lamping can be utilized without the requirement for expensive custom opto-coupler TRIAC or SCR assemblies.

Accordingly, it is an object of the invention to provide an HID bi-level dimming system utilizing high wattage lamping and switched by means of parallel capacitors and further employing voltage suppression to permit utilization of electronic switches of conventional and inexpensive design such as are normally employed in systems utilizing lower wattage lamping.

It is another object of the invention to provide a parallel capacitor switching circuit for HID bi-level dimming systems wherein voltage suppression is utilized to eliminate or clamp the voltage of capacitors on opening of an electronic switch.

It is a further object of the invention to provide an inexpensive control circuit for bi-level dimming systems utilizing high wattage HID lamping operable with an inexpensive electronic switch and other conventional circuitry components.

It is yet another object of the invention to provide an improved powered capacitor switching arrangement for use in technical fields other than lighting control.

Further objects and advantages of the invention will become more readily apparent in light of the following detailed description of the preferred embodiments.

DESCRIPTION OF THE PREFERRED EMBODIMENTS

The disclosures of U.S. Pat. Nos. 4,931,701; 5,217,048; 5,811,939 and 6,031,340 are incorporated hereinto by reference.

Figure 1:
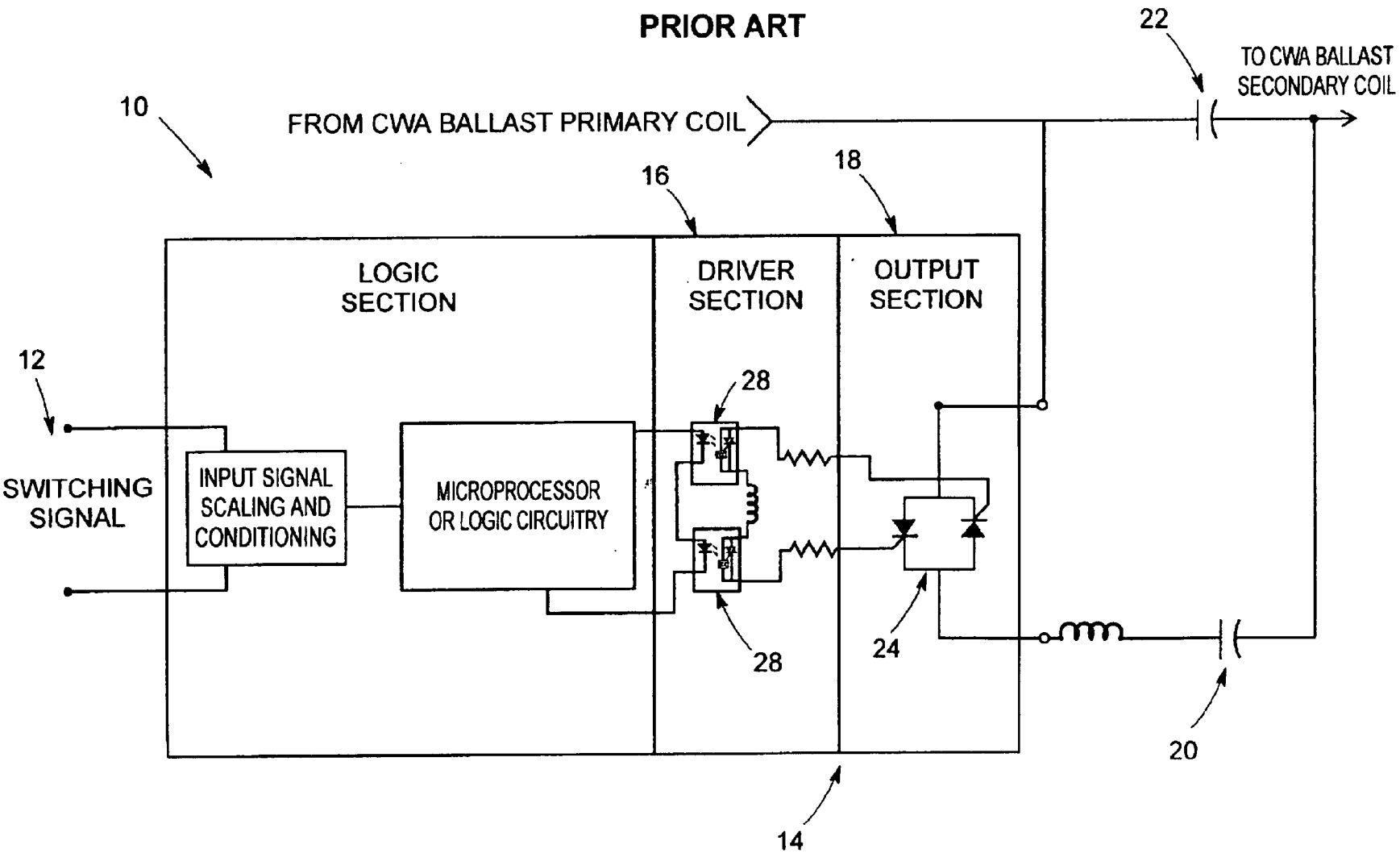
Fig. 1 PRIOR ART
FIG. 1 is a circuitry diagram illustrating a prior art control circuit used in bi-level dimming systems employing high intensity discharge lamping.

Referring now to the drawings and particularly to FIG. 1, a conventional switching circuit is seen at 10 to be operable from a switching signal supplied at 12 for control of a bi-level dimming system (partially shown in FIG. 1) utilizing high intensity discharge lamping (not shown in FIG. 1). The circuit 10 comprises an electronic relay seen generally at 14 to have a driver section 16 and an output section 18. The electronic relay 14 essentially takes the form of a conventional electronic switch. In the circuit 10, a capacitor 20 is switched in and out of parallel with a capacitor 22. The output section 18 of the electronic relay provides this switching function. In operation, a maximum peak voltage rating must be in excess of the combined peak voltage of the capacitors 20, 22. The parallel capacitors 20, 22 in prior art systems are switched on conventional CWA or constant wattage ballasts (not shown) with electronic zero-crossing switches, such as the electronic relay 14, typically comprised of back-to-back SCR devices 24. Such output devices can also comprise TRIAC devices. The output section 18, that is, the SCR devices 24 in the prior art embodiment shown, must be capable of sustaining twice the peak voltage of the capacitor 22 since the relay 14 must open at zero current which for a capacitor is peak voltage. In the next half cycle, the voltage of the powered capacitor, that is, the capacitor 22, opposes that charge left on the capacitor 20 which is switched out. Bleeder resistors (not shown) can be utilized to slowly discharge the switched-out capacitor 20 but will not cause appreciable decrease for a number of cycles. Conventional electronic relays and switching devices such as the relay 14 are limited to applications wherein 400 watt HID lamping is used due to the fact that the output section 18 of the relay 14 cannot operate above a certain maximum voltage. In systems using higher wattage HID Tamping, switch output devices must be capable of withstanding breakover voltages in excess of 1000 volts with certain specifications requiring the ability to withstand 1600 volts. Even with the use of two 600 volt opto-coupler TRIACS in series in the driver section 16 such as are represented by the opto-couplers 28, only 1200 volts can be accommodated even with devices of custom design requiring substantial expense. Cost constraints do not permit the utilization of even 1200 volt SCR devices.

FIG. 1 also illustrates in the circuitry 10 a conventional logic section having a well-known function. A logic section so configured can be utilized in a system employing the advances in the art described herein.

Figure 2:
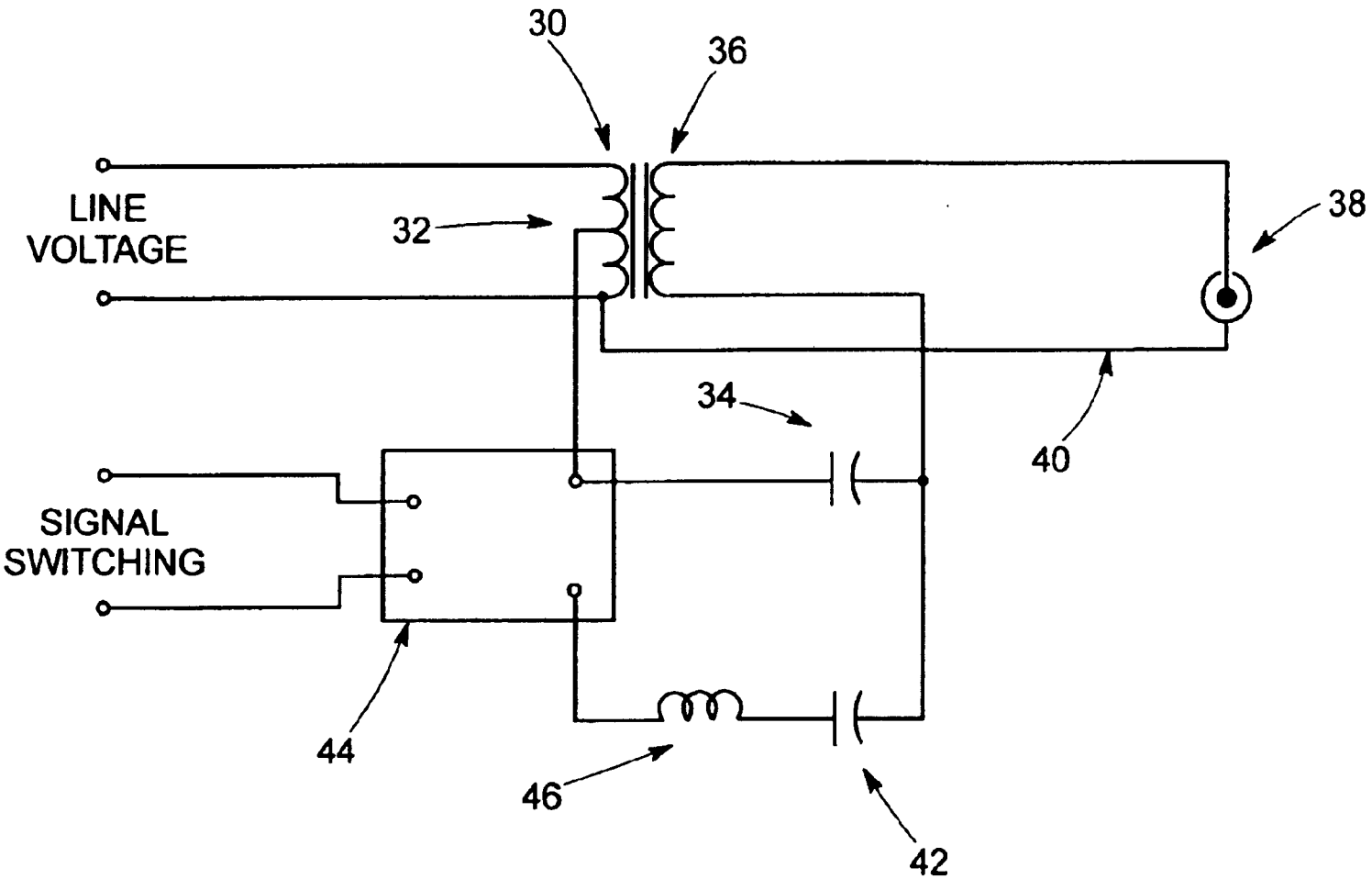
FIG. 2 is a simplified system circuit diagram of a bi-level dimming system generally configured according to the invention; and, FIG. 3 is a circuit diagram illustrating a switching circuit configured according to the invention.

Accordingly, the intent of the present system as is schematically illustrated in FIG. 2 is the provision of circuitry configured to permit the use of circuitry components of lower voltage rating than could conventionally be employed in HID bi-level dimming systems employing HID tamping of wattages such as 1000 to 1500 watts. In the system schematically illustrated in FIG. 2, line voltage is supplied to a primary ballast coil 30 having a tap 32 connected to an unswitched capacitor 34 connected in series with a ballast secondary coil 36. The coils 30 and 36 form portions of a CWA ballast as is used in bi-level dimming systems. The secondary coil 36 is connected to lamp 38, the return connection to the lamp 38 being to a common line 40 also connected to the primary coil 30. The lamp 38 according to the invention typically takes the form of a 1000 watt or 1500 watt metal halide lamp or similar HID lamping. A switched capacitor 42 is connected in parallel with the unswitched capacitor 34 through electronic switch 44 and transient current inductor 46.

The electronic switch 44 functions in a manner similar to the functioning of the electronic relay 14 of FIG. 1. It is to be understood that the circuitry of the electronic switch 44 includes conventional output devices of a voltage rating typical of such output devices used in circuits such as the circuit 10 of FIG. 1. Such relatively low voltage rated output devices can be employed according to the teachings of the invention with relatively high wattage HID lamping such as the lamp 38 through the use of voltage suppression as will also be described relative to FIG. 3.

Figure 3:
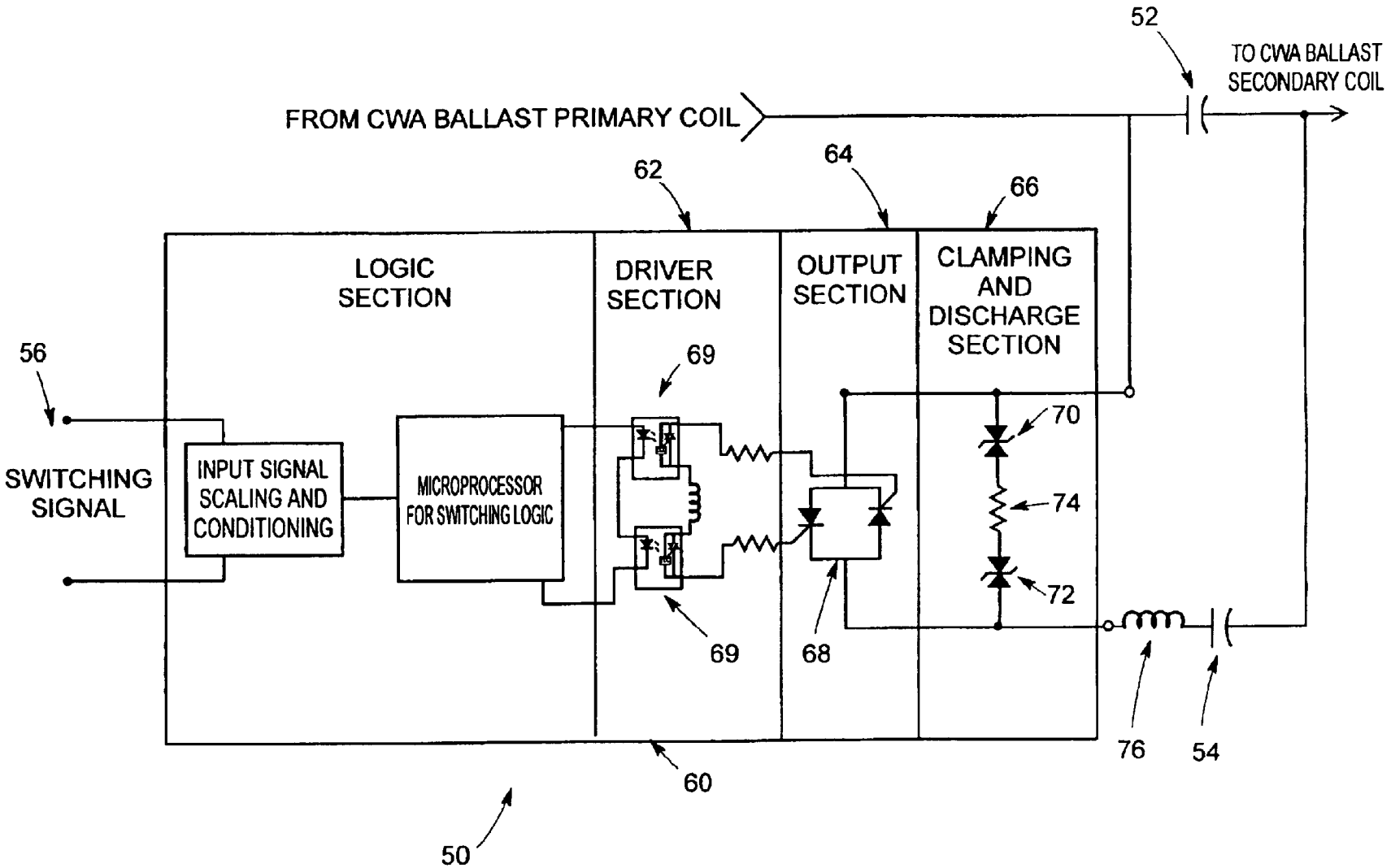

Referring now primarily to FIG. 3, circuitry configured according to the invention is seen at 50 to employ a main or unswitched capacitor 52 and a switched capacitor 54, the circuitry 50 being supplied with a switching signal as indicated at 56 as is conventional in the art. It is to be understood that the electronic switch 44 of FIG. 2 preferably takes the form of the electronic switch 60 of FIG. 3. The circuitry 50 includes the electronic switch seen at 60 having driver section 62, output section 64 and clamping and discharge section 66. The output section 64 is formed of back-to-back SCR devices 68. As such, portions of the electronic switch 60 such as the output section 64 take the form of a conventional low voltage output device such as are employed in the prior art for use with lower wattage HID lamping. The driver section 62 of the switch 60 includes conventional opto-coupler TRIAC devices 69 arranged in series, the TRIAC devices 69 also taking the form of conventional relatively low voltage output devices as are commonly used with relatively low wattage lamping in HID bi-level systems as previously described relative to FIG. 1. As also described relative to FIG. 2, the circuitry 50 of FIG. 3 can be provided with a transient current inductor 76.

Voltage suppression is provided in the circuitry 50 essentially through the operation of the clamping and discharge section 66 of the switch 60 by means of two transient voltage suppressors 70 and 72 that can conveniently take the form of Transzorb devices, a trademark of General Semiconductor, Inc. of Melville, N.Y. 11747, the suppressors 70, 72 being disposed across the electronic switch 60, that is, across a portion of the circuitry 50 forming an electronic relay, for the purpose of discharging residual charge from the switched capacitor 54 when the combined peak voltage exceeds the clamping voltage of the suppressors 70, 72. The maximum (peak or DC) voltage rating of the electronic switch 60 can thus be lower than previously required ratings. When the clamping voltage of the suppressors 70, 72 is specified to be lower than the peak voltages of the capacitor 50, 52, the suppressors 70, 72 will clamp and conduct when the combined voltage exceeds the clamping voltage. The clamping function continues as conduction pulses occur over subsequent cycles until the voltage of the switched capacitor 54 and the peak voltage of the unswitched capacitor 52 no longer combine to exceed the clamping voltage of the suppressors 70, 72. Resistor 74 in series with the suppressors 70, 72 can be used to limit the maximum current of conduction pulses. A relay portion of the electronic switch 60 including the resistor 74 and the transient voltage suppressors 70, 72 as described is thus capable of capacitive switching at the higher voltage levels associated with the utilization of relatively higher wattage lamping such as the lamp 31' of FIG. 2. The voltage suppressors 70, 72 lower peak voltage across the electronic switch 60 by more than 300 volts, thereby allowing utilization of conventional driver and output components, such as conventional components as seen in FIG. 1 and as also described relative to FIG. 3, in switched capacitor circuitry where peak voltage would normally exceed component ratings. The voltage suppressors 70, 72 act to accurately clamp voltage to permit a controlled clipping time and magnitude per cycle. Under these conditions, the suppressors 70, 72 will not overheat due to excessive energy dissipation but will maintain peak voltage below predetermined limits, thereby permitting control of voltage and power levels to a degree improved relative to circumstances ordinarily associated with transient suppression.

Although not expressly shown in FIGS. 2 and 3, a system employing the present invention can be controlled by a microprocessor typically having a 3 to 24 volt DC input or an 80 to 480 volt AC input. Such a microprocessor can be driven by driving opto-couplers that can conveniently take the form of 600 volt zero-crossing opto-isolators with TRIAC output in series with back-to-back SCR switches having a combined voltage rating of 1200 volts. Suppression according to the invention in such as system can be provided by two 550 watt Transzorb devices with series resistance for limiting the maximum current of conduction pulses.

While the invention has been described herein with reference to particular embodiments thereof, it is to be understood that the invention can be configured other than as is explicitly described herein, the scope of the invention being defined by the recitations of the appended claims. In particular, the invention can be used in powered capacitor switching arrangements in other than the lighting field.

What is claimed is:

1. In a bi-level control system switched by means of capacitive switching and having an unswitched capacitor and a switched capacitor, an electronic switch for operation of relatively high wattage load, the improvement comprising transient voltage suppression means across the electronic switch for discharging residual charge from the switched capacitor when combined peak voltage exceeds clamping voltage of said transient voltage suppression means.

2. In the system of claim 1 wherein the load comprises relatively high wattage HID lamping.

3. In the system of claim 1 wherein the transient voltage suppression means has a clamping voltage that is greater than peak voltage of the unswitched capacitor.

4. In the system of claim 1 wherein the voltage suppression means clamps voltage when combined voltage exceeds the clamping voltage of said means, thereby permitting control of clipping time and magnitude per cycle.

5. In the system of claim 1 and further comprising a microprocessor for driving the electronic switch.

6. In the system of claim 1 wherein the electronic switch comprises back-to-back SCR or TRIAC switching devices.

7. In the system of claim 1 wherein the electronic switch comprises zero-crossing opto-coupler devices.

8. In the system of claim 7 wherein the opto-coupler devices have TRIAC output.

9. In the system of claim 1 wherein the transient voltage suppression means comprises voltage suppressors in series.

10. In the system of claim 9 and further comprising a resistor in series with the voltage suppressors.

11. In the system of claim 9 wherein the voltage suppressors are Transzorb devices.

12. In the system of claim 2 wherein the lamping comprises at least one lamp having a wattage of 1000 watts or greater.

13. In the system of claim 1 wherein the electronic switch comprises back-to-back 1200 volt SCR switching devices.

14. In the system of claim 1 wherein the electronic switch comprises 600 volt zero-crossing opto-coupler devices.

15. In a bi-level control system switched by means of capacitive switching and having an unswitched capacitor and a switched capacitor, an electronic switch for operation of relatively high wattage load, the improvement comprising transient voltage suppression means across the electronic switch for discharging residual charge from the switched capacitor when combined peak voltage exceeds clamping voltage of said transient voltage suppression means, the transient voltage suppression means having a clamping voltage that is greater than peak voltage of the unswitched capacitor.

16. In the system of claim 15 wherein the load comprises relatively high wattage HID lamping.

17. In a bi-level control system switched by means of capacitive switching and having an unswitched capacitor and a switched capacitor, an electronic switch for operation of relatively high wattage load, the improvement comprising transient voltage suppression means across the electronic switch for discharging residual charge from the switched capacitor when combined peak voltage exceeds clamping voltage of said transient voltage suppression means, the transient voltage suppression means clamping voltage when combined voltage exceeds the clamping voltage of said means, thereby permitting control of clipping time and magnitude per cycle.

18. In a bi-level control system switched by means of capacitive switching and having an unswitched capacitor and a switched capacitor, an electronic switch for operation of relatively high wattage load, the improvement comprising transient voltage suppression means across the electronic switch for discharging residual charge from the switched capacitor when combined peak voltage exceeds clamping voltage of said transient voltage suppression means, the electronic switch comprising zero-crossing opto-coupler devices.

19. In a bi-level control system switched by means of capacitive switching and having an unswitched capacitor and a switched capacitor, an electronic switch for operation of relatively high wattage load, the improvement comprising transient voltage suppression means across the electronic switch for discharging residual charge from the switched capacitor when combined peak voltage exceeds clamping voltage of said transient voltage suppression means, the transient voltage suppression means comprising voltage suppressors in series.

20. In a bi-level control system switched by means of capacitive switching and having an unswitched capacitor and a switched capacitor, an electronic switch for operation of relatively high wattage load, the improvement comprising transient voltage suppression means across the electronic switch for discharging residual charge from the switched capacitor when combined peak voltage exceeds clamping voltage of said transient voltage suppression means, the load comprising relatively high wattage HID lamping, the lamping comprising at least one lamp having a wattage of 1000 watts or greater.

21. In a bi-level control system switched by means of capacitive switching and having an unswitched capacitor and a switched capacitor, an electronic switch for operation of relatively high wattage load, the improvement comprising transient voltage suppression means across the electronic switch for discharging residual charge from the switched capacitor when combined peak voltage exceeds clamping voltage of said transient voltage suppression means, the electronic switch comprising back-to-back 1200 volt SCR switching devices.

22. In a bi-level control system switched by means of capacitive switching and having an unswitched capacitor and a switched capacitor, an electronic switch for operation of relatively high wattage load, the improvement comprising transient voltage suppression means across the electronic switch for discharging residual charge from the switched capacitor when combined peak voltage exceeds clamping voltage of said transient voltage suppression means, the electronic switch comprising 600 volt zero-crossing opto-coupler devices.

* * * * *